US012061061B2

(12) United States Patent
Kintz et al.

(10) Patent No.: US 12,061,061 B2
(45) Date of Patent: Aug. 13, 2024

(54) MAGAZINE ADAPTER

(71) Applicant: Blind Squirrel Enterprises, LLC, Westerly, RI (US)

(72) Inventors: Paul Kintz, Westerly, RI (US); Alexander Kintz, Cocoa, FL (US); Stephen Bukowsky, Clinton, CT (US)

(73) Assignee: Blind Squirrel Enterprises LLC, Westerly, RI (US)

( * ) Notice: Subject to any disclaimer, the term of this patent is extended or adjusted under 35 U.S.C. 154(b) by 22 days.

(21) Appl. No.: 17/945,460

(22) Filed: Sep. 15, 2022

(65) Prior Publication Data

US 2024/0093955 A1 Mar. 21, 2024

(51) Int. Cl.
*F41A 9/71* (2006.01)
*F41A 9/61* (2006.01)
*F41A 11/02* (2006.01)

(52) U.S. Cl.
CPC *F41A 9/61* (2013.01); *F41A 9/71* (2013.01); *F41A 11/02* (2013.01)

(58) Field of Classification Search
CPC .. F41A 11/02; F41A 9/71; F41A 33/00; F41A 9/61
See application file for complete search history.

(56) References Cited

U.S. PATENT DOCUMENTS 4,220,071 A * 9/1980 Seiderman ..... F41A 11/02 89/197
4,515,064 A * 5/1985 Hohrein ..... F41A 11/02 42/49.02
8,677,880 B2 * 3/2014 Bowles ..... F41A 9/70 89/34
8,898,946 B1 12/2014 Johnson
9,927,193 B2 * 3/2018 Beasley ..... F41A 9/71
10,598,454 B2 * 3/2020 DiChario ..... F41A 33/00
(Continued)

FOREIGN PATENT DOCUMENTS

DE 202017005204 U1 12/2017

OTHER PUBLICATIONS

Hrachya H, Matador Arms Mag-X (P320) AR-15 Magazine Adapter, Apr. 3, 2019, TheFirearmBlog.com, All Pages, <https://www.thefirearmblog.com/blog/2019/04/03/matador-arms-mag-x-p320-ar-15-magazine-adapter/>. (Year: 2019).*
(Continued)

*Primary Examiner* — Jonathan C Weber
(74) *Attorney, Agent, or Firm* — The Webb Law Firm

(57) ABSTRACT

A firearm magazine adapter to be affixed to a non-native magazine to allow the adapted magazine to fit and function in a firearm that normally cannot accept the non-native magazine. Embodiments comprise two or three primary elements: two clamshell halves for the body or a one-piece body, and an ejector which is captive, for use with a non-native magazine, in the body. In one embodiment the magazine adapter is free of moving parts. In one embodiment, two screws hold the clamshell halves together and secure the ejector via a partial cylindrical negative volume. In use, the assembly is permanently and removably affixed to a non-native magazine. A single, unmodified release on the firearm releases the adapted magazine from the firearm.

6 Claims, 5 Drawing Sheets

(56) References Cited

U.S. PATENT DOCUMENTS

| | | | | |
|---|---|---|---|---|
| 2012/0073429 | A1* | 3/2012 | Bowles | F41A 9/70<br>89/138 |
| 2017/0138685 | A1* | 5/2017 | Beasley | F41A 9/71 |
| 2018/0031343 | A1* | 2/2018 | Caudle | F41A 3/86 |
| 2018/0180371 | A1* | 6/2018 | Beasley | F41A 9/71 |
| 2019/0226779 | A1* | 7/2019 | DiChario | F41A 9/71 |

OTHER PUBLICATIONS

Travis Pike, "Gear Review: Matador Arms Mag-X System for 9mm Pistol Caliber Carbines", Feb. 8, 2020, Thetruthaboutguns.com, All Pages, <https://www.thetruthaboutguns.com/gear-review-matador-arms-mag-x-system/>. (Year: 2020).*

GBGuns, "Make a Sig P320 PCC with Matador Arms Mag X P320", May 7, 2019, YouTube, Entire Video, <https://www.youtube.com/watch?v=y-PS5pUKE4Q&t>. (Year: 2019).*

* cited by examiner

SECTION A-A

MAGAZINE ADAPTER

BACKGROUND OF THE INVENTION

Prior art includes US Patent Publication US20190226779A1, U.S. Pat. No. 8,898,946, U.S. patent Ser. No. 10/591,234B2, U.S. Pat. No. 8,726,554B2, U.S. patent Ser. No. 10/598,454B2, and German Patent Publication DE202017005204U1.

Many firearms, such as pistols, use a detachable magazine to hold ammunition rounds. There are multiple different models of such magazines. Typically, a particular firearm can accept only a native magazine. There are popular magazine mechanical standards, such as STANAG 4179 (a NATO standard) for a magwell and a Colt 1911 pattern for a magazine.

It is advantageous to be able to use a non-native magazine in a firearm. The typical way of achieving such advantage is by using an adapter. In the prior art, such adapters have one or more of the following weaknesses: (i) The adapter has moving parts. (ii) The non-native magazine can be detached from the adapter while the mechanical adapter is secured in a magazine well of the firearm. (iii) One or more elements of the adapter attach to the firearm, not to the non-native magazine. (iv) The firearm must be modified to use the adapter.

To improve durability, it is advantageous for an adapter to be free of moving parts. It is also advantageous for a non-native magazine to be non-removably affixed in the adapter while the adapter is secured in the magazine well of the firearm, but removably affixed in the adapter when the adapter is not secured in the magazine well of the firearm, so as to limit methods by which the non-native magazine may detach from the firearm during use. Furthermore, it is advantageous to have all elements of the adapter attached to the non-native magazine or another element of the adapter, not to the firearm. Finally, it is advantageous to not modify the firearm.

SUMMARY OF THE INVENTION

Embodiments of this invention overcome the weaknesses in prior art. Embodiments include a magazine adapter that attaches to a non-native magazine creating an adapted magazine. Multiple ready-to-use adapted magazines may be created by attaching a magazine adapter to each of multiple non-native magazines. One improvement is that embodiments are free of moving parts. Another improvement of embodiments is that the non-native magazine is non-removably affixed in the magazine adapter while the adapted magazine is secured in a magazine well of a firearm, but removably affixed in the magazine adapter when the magazine adapter is not secured in the magazine well of the firearm. Yet another improvement of embodiments is that all elements of the magazine adapter attach to the non-native magazine or other elements of the magazine adapter. Yet another improvement of embodiments is that usage of the magazine adapter does not require modification of the firearm.

In one embodiment, a magazine adapter comprises three primary elements: a magazine adapter body, an ejector, and magazine adapter body assembly screws. The magazine adapter body consists of two clamshell halves. The clamshell halves are secured to each other with the magazine adapter body assembly screws. The ejector is captured between the two clamshell halves when assembled. In other embodiments the magazine adapter body is a single piece.

In another embodiment, the shape of the magazine adapter body and the ejector permit only a single attachment location and orientation of the ejector, and a single insertion and orientation of an adapted magazine in a magazine well of a firearm. The magazine adapter body comprises an interior slot, into which a non-native magazine can be secured.

In yet another embodiment, one of the magazine adapter body assembly screws, that secures one clamshell half to the other clamshell half, also secures the ejector in the magazine adapter.

In yet another embodiment, the magazine adapter body comprises an interior slot suitably shaped, oriented, and sized to accept a non-native magazine in a single, fixed location and orientation.

In yet another embodiment, the non-native magazine can be detached from the magazine adapter by removing the magazine adapter body assembly screws and disassembling the magazine adapter. While the adapted magazine is not secured in the magazine well, the magazine adapter body screws are accessible, and the non-native magazine is removably affixed in the magazine adapter. While the adapted magazine is secured in a magazine well of a firearm, the magazine adapter body screws are inaccessible, causing the non-native magazine to be non-removably affixed in the magazine adapter. Other embodiments may use other methods of securing the magazine adapter body to the non-native magazine. In other embodiments, the magazine adapter body assembly screws do not need to be fully removed before the non-native magazine can be detached from the magazine adapter.

In one usage scenario, a user assembles an embodiment comprising two clamshell halves, an ejector, two magazine adapter body assembly screws, and a non-native magazine into a single unit, an adapted magazine. The user can use multiple magazine adapters on multiple non-native magazines to create a set of ready-to-use adapted magazines, with a one-to-one relationship between magazine adapters and non-native magazines. One advantage of an embodiment is that the firearm is not modified.

In another usage scenario, a user has two firearms. Without modification to either firearm, a single adapted magazine can be used in the first firearm, removed from the first firearm, then used in the second firearm. One advantage of an embodiment in the usage scenario is that all elements of the magazine adapter attach to the non-native magazine or another element of the magazine adapter, not to the firearm.

In yet another usage scenario, a user drops an adapted magazine while reloading a firearm. One advantage of an embodiment is that the adapted magazine is free of moving parts, which may be prone to breaking.

Embodiments of this invention overcome weaknesses of prior art. Embodiments include a magazine adapter that attaches to a non-native magazine. Magazine adapters may be used on multiple magazines to create ready-to-use adapted magazines. One improvement is that removal of the adapted magazine may now use the native magazine release in the firearm.

DETAILED DESCRIPTION

Scenarios, options, drawings, and abstract are non-limiting embodiments.

Figure 1:
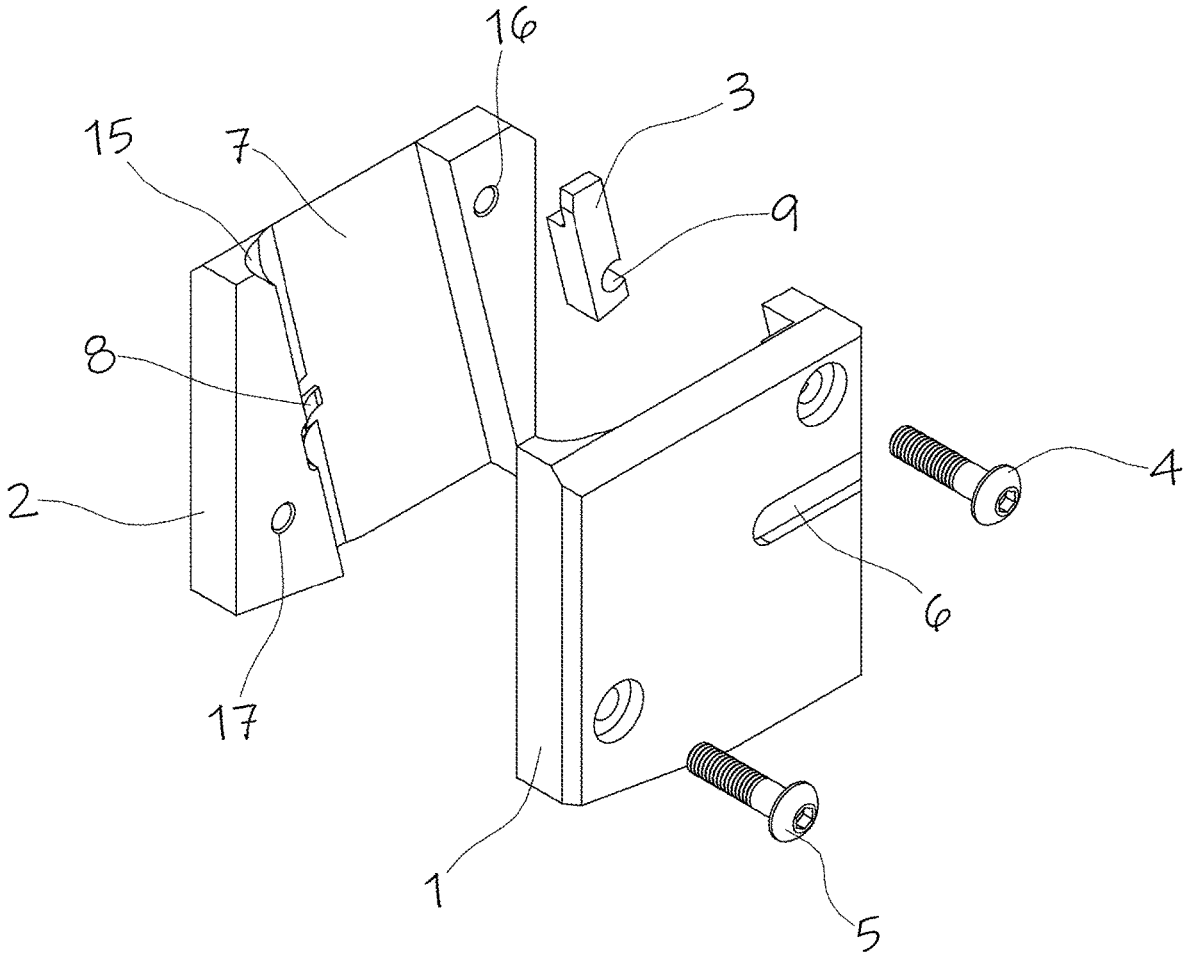
FIG. 1 shows an exploded isometric view of an embodiment.

Starting with FIG. 1, we see an exploded isometric view of an embodiment. The clamshell halves are 1 and 2, which may be identified as a left half and right half respectively, although such adjectives are arbitrary. Clamshell halves 1 and 2, or any combination thereof, may also be called the magazine adapter body. Note that locations, orientations, and shapes of embodiment elements are non-symmetric such that only a single orientation of: (i) the clamshell halves, (ii) an ejector, (iii) a non-native magazine, and (iv) a fit of an adapted magazine into a magwell of a firearm is possible. A fixed ejector 3 is a captive element secured between the two clamshell halves when assembled. Two magazine adapter body assembly screws 4 and 5 are shown. These may be identified as posterior screw and anterior screw, respectively, although such adjectives are arbitrary. Other embodiments use a different number of magazine adapter body assembly screws. Other embodiments may use alternative means of attachment of clamshell halves and securing of an ejector, such as bolts, mechanical catches, ties, adhesives, magnets, press fit, hook and loop fasteners, and the like. Other embodiments may use an alternative arrangement of securing an ejector. Other embodiments may use an ejector as part of a clamshell half. Other embodiments may implement or manufacture a magazine adapter body as a single element, such as by injection molding or 3D printing. The shown embodiment, when assembled using elements 1, 2, 3, 4, and 5, is identified herein as magazine adapter.

When the magazine adapter is assembled, the clamshell halves 1 and 2 create an interior slot 7 suitable for holding a non-native magazine. A magazine catch slot key 8 assists in holding the non-native magazine in a single, fixed position in the interior slot 7. The magazine adapter body ideally has a hardness of at least 50 on the Shore D hardness scale.

A novel element of some embodiments is an asymmetric ejector securing element 9 comprising a partial cylindrical negative volume through which one of the magazine adapter body assembly screws, such as 4, passes. The asymmetric ejector securing element 9 allows a fixed ejector 3 to be secured with the magazine adapter body assembly screw 4, that also secures the clamshell halves 1 and 2 together. The asymmetric ejector securing element 9 also permits the ejector 3 to be positioned for functionality, in conjunction with an ejector mechanism in the firearm, and to also have the necessary clearances for both the interior slot 7 and exterior of the magazine adapter body. Ideally, the ejector 3 has a hardness in the inclusive range of 20 to 35 on the Rockwell HRC scale.

A magazine well engagement slot 6, a negative volume facet of the magazine adapter, is engaged by a magazine release of the firearm to secure the magazine adapter in the magazine well. The magazine well engagement slot 6 enables the magazine adapter to fit and function properly in the firearm.

In some embodiments, the magazine adapter body comprises a feed ramp surface 15, for the purpose of reliably feeding a cartridge in the non-native magazine into a chamber of the firearm. Elements shown in dotted lines are not part of the claimed invention. See also Definitions below and Claims.

Figure 2:
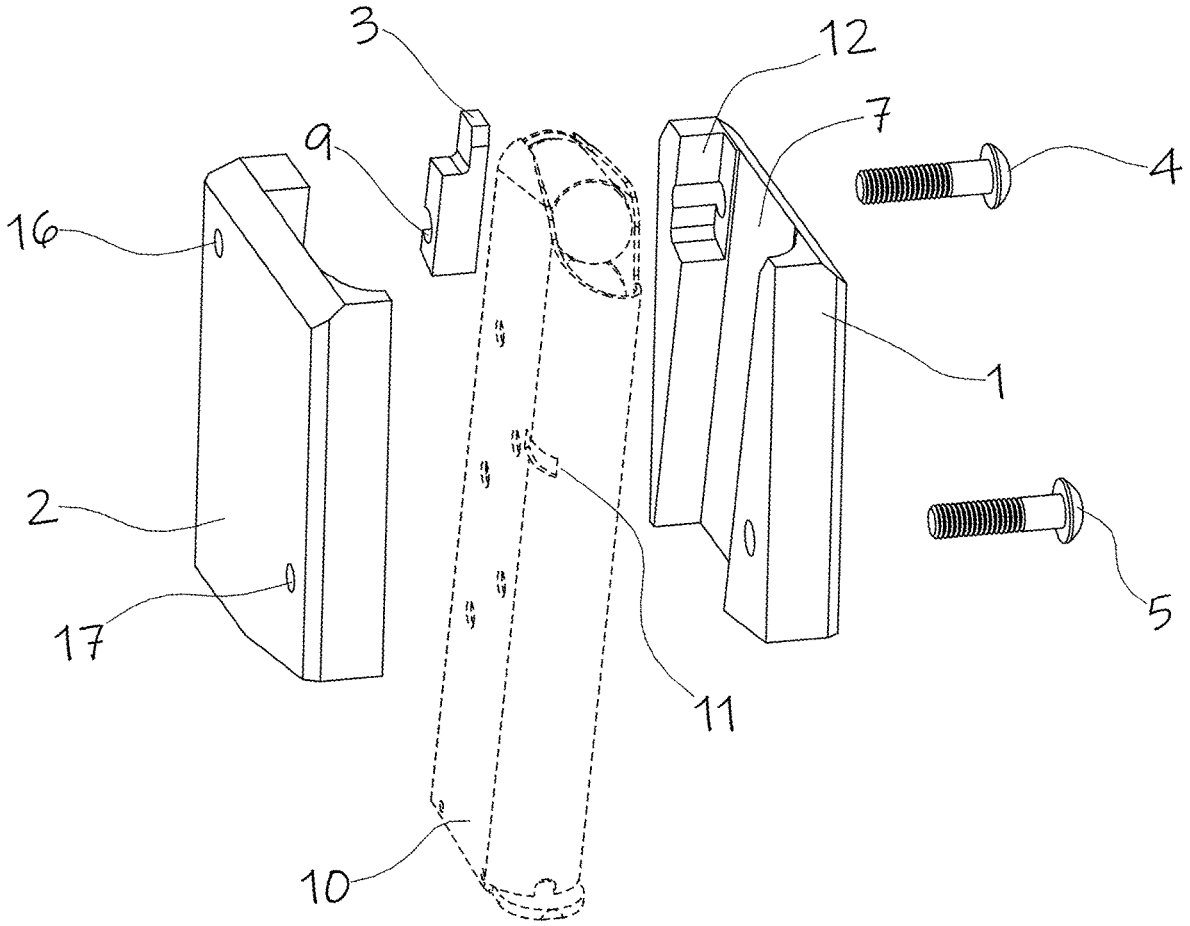
FIG. 2. Shows an exploded isometric view of an embodiment with a Colt 1911 pattern non-native magazine.

Turning now to FIG. 2, we see many of the same elements, with the same reference designators, as in FIG. 1. FIG. 2 is an exploded isometric view from a different viewing angle than FIG. 1. FIG. 2 also shows a Colt 1911 pattern non-native magazine 10 such as would be captured and affixed in a magazine adapter, in interior slot 7, in a typical use. 11 shows a magazine catch slot in the non-native magazine 10 that engages with the magazine catch slot key 8. 12 shows a negative volume to accommodate an ejector 3 in the magazine adapter. The non-native magazine 10 is not part of embodiments. Elements shown in dotted lines are not part of the claimed invention.

Figure 3:
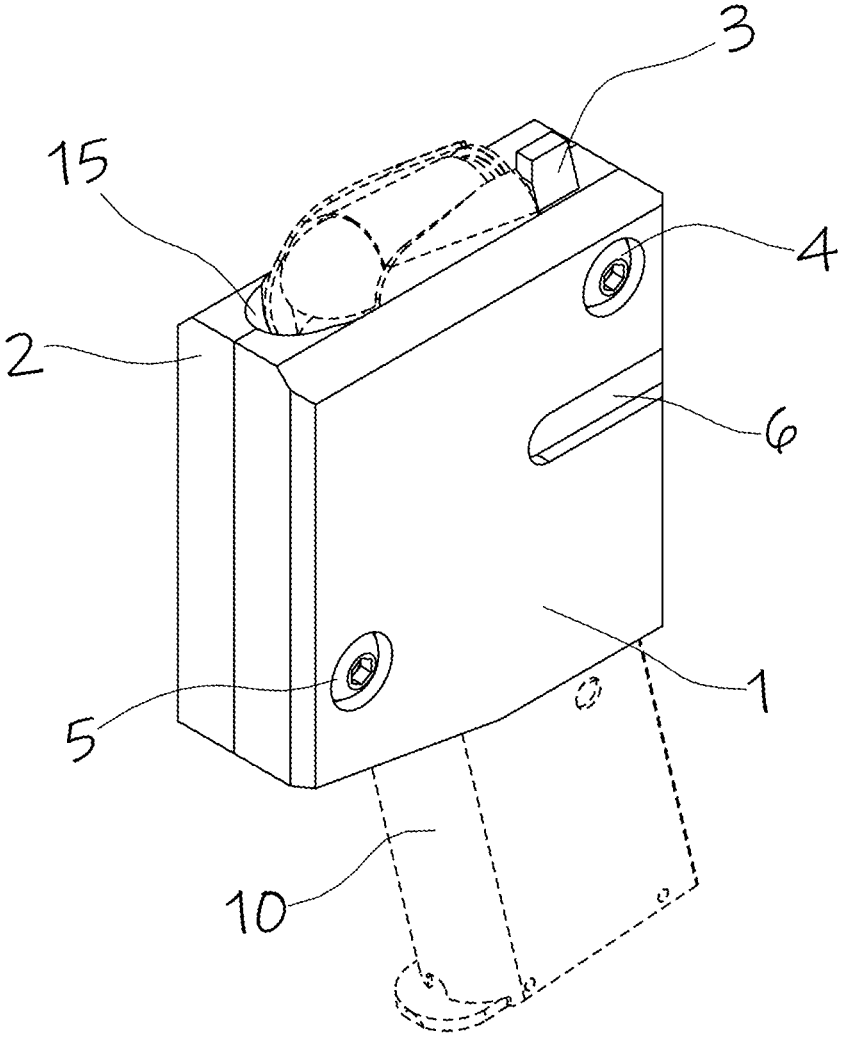
FIG. 3 shows an assembled isometric view of an assembled embodiment with a non-native magazine.

Turning now to FIG. 3 we see an isometric view of an adapted magazine. Magazine adapter body assembly screw 5 passes through clamshell half 1 into a mating threaded receptacle 17 in clamshell half 2. Magazine adapter body assembly screw 4 passes through clamshell half 1, then through the asymmetric ejector securing element 9 in the ejector 3, then into a mating threaded receptacle 16 in clamshell half 2. Magazine adapter body assembly screw 4 serves both to attach (in conjunction with magazine adapter body assembly screw 5) the clamshell halves 1 and 2 together and to retain the ejector 3. Elements shown in dotted lines are not part of the claimed invention.

Figure 4:
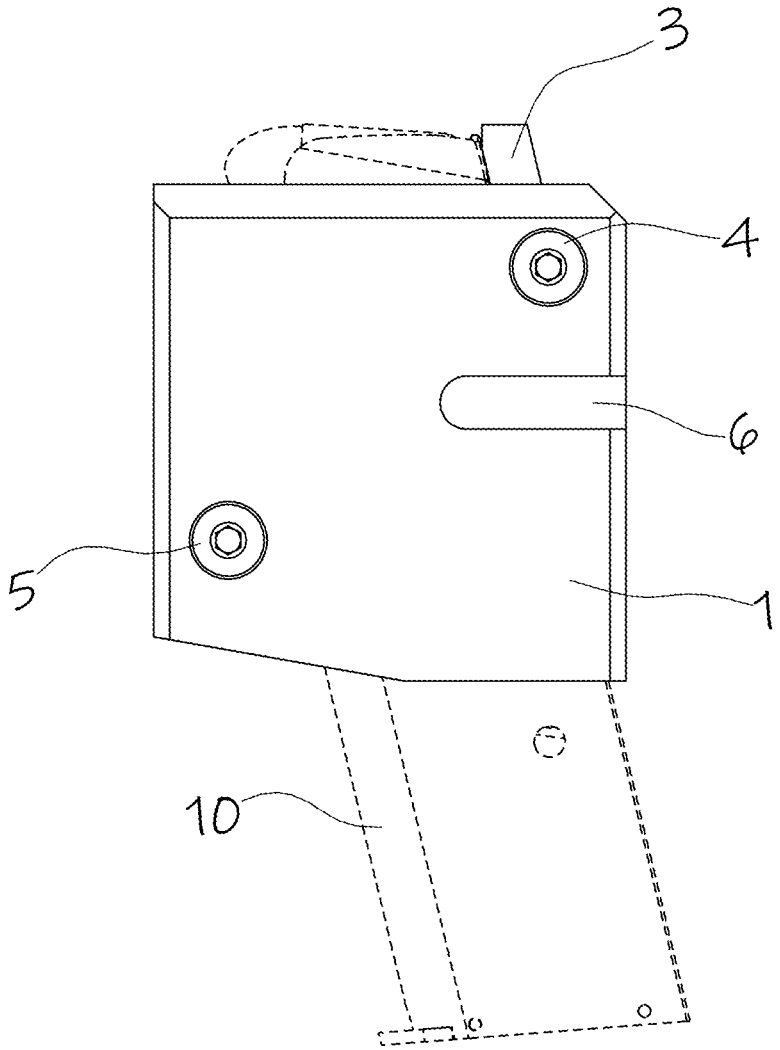
FIG. 4 shows a side view of an adapted magazine consisting of an assembled embodiment with a Colt 1911 pattern non-native magazine.

Turning now to FIG. 4 we see a side view of an adapted magazine, consisting of an embodiment of a magazine adapter with a Colt pattern 1911 non-native magazine 10 installed. Reference designators in FIG. 4 are for the same elements as shown and described in FIGS. 1-3. Elements shown in dotted lines are not part of the claimed invention.

Figure 5:
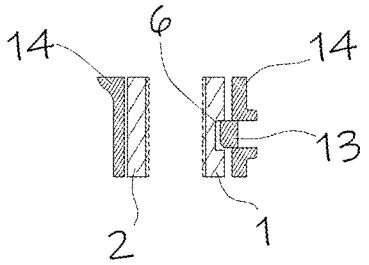
FIG. 5 shows the adapted magazine of FIG. 4. secured in a magazine well of a firearm with a cross-section.
Figure 5:
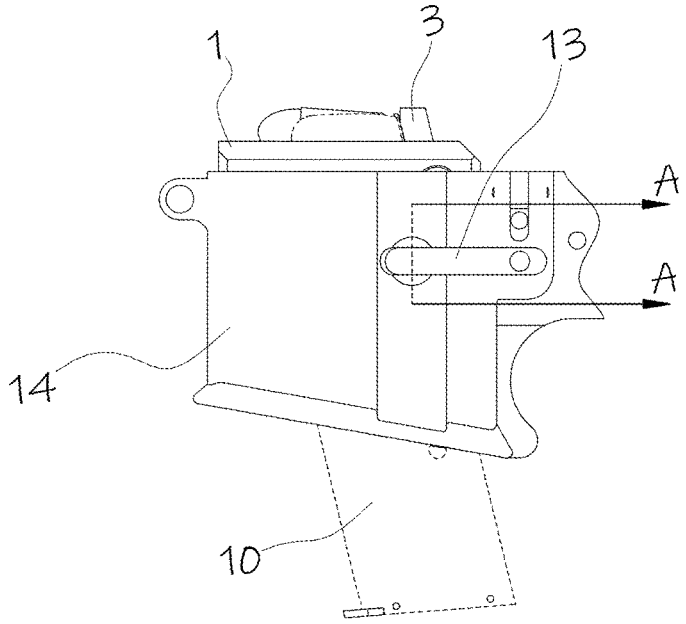

Turning now to FIG. 5. We see adapted magazine of FIG. 4 secured in a magazine well 14 of a firearm. FIG. 5 also shows a cross-section A-A, showing a portion of the magazine adapter body, such as clamshell halves 1 and 2, and a (part of the firearm) 13 and a portion of the magwell 14 (also part of the firearm). Elements 13 and 14 are not part of claimed embodiments. The magazine release 13 engages with a magazine well engagement slot 6 on the exterior of clamshell half 1, also shown in FIG. 1, FIG. 3 and FIG. 4. FIG. 5 also shows that the magazine adapter body assembly screws 4 and 5, visible in FIG. 4, are inaccessible while the adapted magazine is secured in the magazine well. Elements shown in dotted lines are not part of the claimed invention.

Significant asymmetries in both clamshell halves 1 and 2, or an equivalent one-piece body, and ejector 3 assure that assembly of an embodiment is possible in only a single orientation of elements. Further, such asymmetries assure proper fit and function of the adapted magazine into a firearm, including use of an existing magazine release on the firearm. Refer to FIGS. 1-5 to see such asymmetries.

Mechanical tolerances are a critical part of any mechanical design, as those trained in the art know. Useful and preferred tolerances and measurements for some embodiments include:

- Angle tolerances: ±5 degrees, ±3 degrees, ±5 degrees, or ±¼ degrees,
- Linear measurement tolerances: ±15 percent, ±5 percent, 2 percent, or ±½ percent.
- Magazine rotation: the magazine in the adapter is rotated 13.5 degrees, counterclockwise, when viewing the firearm from the left side.
- Magazine forward/backward offset: the magazine is offset 0.272 inches from the front of the adapter and is centered left-to-right.

Ejector extension: ejector extends 0.313 inches from the top of the adapter.

Ejector centerline offset: the centermost side of the ejector is. 0.150 inches left of the centerline.

Ejector width: ejector width is 0.100 inches.

Variations of above measurements are "equivalent" under the rule of equivalents.

Definitions

"Adapted magazine"—An assembled combination of a non-native magazine (affixed in a magazine adapter. In use, a non-native magazine is removably affixed in a magazine adapter, creating an adapted magazine, which is then suitable for use in a firearm.

"Fixed ejector"—An alternate term for ejector.

"Side"—also referred to as a "half."

"Magazine release"—a mechanism on a firearm to secure a native magazine in a magazine well. A magazine release can also secure an adapted magazine in the magazine well. A magazine release can also be used to release a native magazine from a magazine well. A magazine release may also be used to release an adapted magazine from the magazine well. Also called a "native magazine release."

Magazine well—identical meaning and interchangeable with "magwell," both of which are common terms of art.

"Native magazine"—A magazine designed to be operably compatible with a firearm.

"Non-native magazine"—A magazine not designed to be operably compatible with a firearm. A non-native magazine may also be referred to as a Colt 1911 pattern non-native magazine.

"Non-removably affixed"—Affixed such that removal would necessarily imply damage to one or more elements.

"Permanently affixed"—Affixed such that removal is unnecessary in use.

"Removably affixed"—Affixed such that removal is possible without physical damage.

Ideal, Ideally, Optimal and Preferred—Use of the words, "ideal," "ideally," "optimum," "should" and "preferred," when used in the context of describing this invention, refer specifically to a best mode for one or more embodiments for one or more applications of this invention. Such best modes are non-limiting and may not be the best mode for all embodiments, applications, or implementation technologies, as one trained in the art will appreciate.

All examples are sample or exemplary embodiments. In particular, the phrase "invention" should be interpreted under all conditions to mean, "an embodiment of this invention." Examples, scenarios, and drawings are non-limiting. The only limitations of this invention are in the claims. May, Could, Option, Mode, Alternative and Feature—Use of the words, "may," "could," "option," "optional," "mode," "alternative," "typical," "ideal," and "feature," when used in the context of describing this invention, refer specifically to various embodiments of this invention. Described benefits refer only to those embodiments that provide that benefit. All descriptions herein are non-limiting, as one trained in the art appreciates.

Embodiments of this invention explicitly include all combinations and sub-combinations of all features, elements, and limitations of all claims. Embodiments of this invention explicitly include all combinations and sub-combinations of all features, elements, examples, embodiments, tables, values, ranges, and drawings in the specification and drawings. Embodiments of this invention explicitly include devices and systems to implement any combination of all methods described in the claims, specification, abstract, and drawings. Embodiments of the methods of invention explicitly include all combinations of dependent method claim steps, in any functional order. Embodiments of the methods of invention explicitly include, when referencing any device claim or limitation thereof, to any and all other device claims, including all combinations of elements in device claims. Claims for devices and systems may be restricted to perform only the methods of embodiments or claims.

We claim:

1. A magazine adapter comprising:

a magazine adapter body;

a magazine well engagement slot in the magazine adapter body to removably and functionally secure the magazine adapter in a magazine well of a firearm;

an interior slot in the magazine adapter body, wherein the interior slot is adapted to accept a non-native magazine;

an ejector which is configured to be operable with an operating mechanism of the firearm;

wherein the magazine adapter assembled with the non-native magazine is an adapted magazine;

wherein the magazine adapter is free of moving parts; and wherein a native magazine release of the firearm releases the adapted magazine from the magazine well of the firearm.

2. The magazine adapter of claim 1, wherein the ejector comprises an asymmetric ejector securing element comprising a partial cylindrical negative volume adapted to accept a magazine adapter body assembly screw to secure the ejector in the magazine adapter body, free of any other securing element.

3. The magazine adapter of claim 1, wherein a native magazine release on the firearm fully releases the adapted magazine from the magazine well of the firearm without removing the non-native magazine from the magazine adapter.

4. The magazine adapter of claim 1, wherein the non-native magazine is adapted to be removably affixed in the magazine adapter while the adapted magazine is not secured in the magazine well of the firearm; and wherein the non-native magazine is adapted to be non-removably affixed in the magazine adapter while the adapted magazine is secured in the magazine well of the firearm.

5. The magazine adapter of claim 1, wherein:

the assembled magazine adapter is exactly a single component free of loose pieces.

6. The magazine adapter of claim 1, wherein:

the elements of the magazine adapter are statically attached to each other when the magazine adapter is assembled.

* * * * *